US007887130B1

(12) United States Patent
Zvolena

(10) Patent No.: US 7,887,130 B1
(45) Date of Patent: Feb. 15, 2011

(54) WORKSTATION

(75) Inventor: Logan D. Zvolena, St. Paul, MN (US)

(73) Assignee: Lockheed Martin Corporation, Bethesda, MD (US)

( * ) Notice: Subject to any disclaimer, the term of this patent is extended or adjusted under 35 U.S.C. 154(b) by 252 days.

(21) Appl. No.: 12/199,460

(22) Filed: Aug. 27, 2008

(51) Int. Cl.
*A47C 3/02* (2006.01)

(52) U.S. Cl. ..... 297/260.2; 297/217.3; 297/327; 297/330

(58) Field of Classification Search ..... 297/217.3, 297/260.2, 326, 327, 330; 5/108, 109
See application file for complete search history.

(56) References Cited

U.S. PATENT DOCUMENTS 3,019,052 A * 1/1962 Zawadzki ..... 297/260.2
4,008,500 A * 2/1977 Hall, Jr. ..... 297/217.3
4,854,301 A * 8/1989 Nakajima ..... 297/217.3
4,880,270 A 11/1989 Cooper
5,056,864 A * 10/1991 Cooper ..... 297/188.21
6,102,476 A * 8/2000 May et al. ..... 297/217.3
6,152,529 A * 11/2000 Beason ..... 297/260.2
6,270,157 B1 * 8/2001 Kapushinski ..... 297/170
6,644,748 B2 11/2003 Tholkes et al.
7,093,900 B1 8/2006 Schon
7,100,517 B1 9/2006 Godwin
7,322,653 B2 1/2008 Dragusin
7,448,680 B2 * 11/2008 DiRe ..... 297/217.3

* cited by examiner

*Primary Examiner*—Peter R. Brown
(74) *Attorney, Agent, or Firm*—Hamre, Schumann, Mueller & Larson, P.C.

(57) ABSTRACT

A moving workstation and its method of operation are described. A workstation described herein includes a chair and operator equipment that move together in a pivoting motion through an automatic, time-controlled program, where an orientation of the chair relative to the operator equipment is maintained during the pivoting motion. Such a workstation can reduce manpower requirements while improving vigilance of workstation operators.

16 Claims, 3 Drawing Sheets

WORKSTATION

FIELD

The disclosure herein generally relates to a workstation and a method of operating a workstation. In particular, the disclosure herein relates to moving a workstation including moving a chair and operator equipment together in a pivoting motion through an automatic and time-controlled program, where an orientation of the chair relative to the operator equipment is maintained during the pivoting motion.

BACKGROUND

There are various occupations where dedicated workstations are needed for carrying out certain work tasks, such as monitoring and communications tasks, which often require constant manpower to operate the workstation. In one particular environment, workstations have been widely used on naval and military ships for performing such tasks. Under ideal circumstances, the number of persons needed to operate such workstations would be kept at a minimum, for example to increase efficiency of the workforce aboard a ship. A solution is to dedicate less people to a particular workstation and have those people operate it for longer periods of time. Unfortunately, such a solution is not practicable with many current workstations, as operators would be required to maintain vigilance while sitting upright in a chair for many hours at a time. Realities remain that operators eventually will fatigue and lose vigilance when operating a workstation over time while in the same position.

Current situations provide workstations that simply include a typical chair dedicated to various operator equipment, where an operator generally remains upright unless the operator actively adjusts his/her position. Other than providing more cushion and/or various manual settings, these workstations are not ideal for increasing operating productivity of any one operator at the workstation.

Further improvements can be made to gain workforce efficiency by increasing productivity of a workstation operator, so as to allow for less people of a workforce to be assigned to a workstation.

SUMMARY

An improved workstation is described. In particular, a workstation is described herein that can improve operator vigilance, while reducing fatigue and physical strain on an operator's body. Generally, the workstation includes a chair and operator equipment that gradually move together under an automatic and time-controlled program. The chair and operator equipment pivot about a pivot point, such that an orientation of the chair relative to the operator equipment is maintained during movement. During movement, the entire chair and the operator equipment including its various workstation instruments move into and out of an upright position and a recline position, and while the orientation between the chair and the operator equipment is maintained.

In one specific application, the workstation and methods described herein can be used for workstations on naval ships, inside military bases, and aircraft such as Airborne Warning and Control Systems aircraft where the weight of the workstation is made light enough to be supported by such aircraft. These examples are meant to be illustrative only and non-limiting, as other applications may be equally or more suitable where reduction of manpower requirements is desired.

One embodiment of a workstation described herein includes a chair, operator equipment, and a base. A pivot point connects the chair and operator equipment to the base. The chair and operator equipment are movable about the pivot point relative to the base. The chair and operator equipment are pivotable together about the pivot point both frontward and backward, and into and out of an upright position and a recline position. During the pivoting movement, the chair and operator equipment are constructed such that an orientation of the chair relative to the operator equipment is maintained. A linkage drives the chair and operator equipment into and out of the upright and recline positions. The linkage is controlled by a control disposed inside the base. The control includes a program that controls the linkage to automatically pivot the chair and operator equipment together into and out of the upright and recline positions, and over a controlled duration.

One embodiment of a method for operating a workstation includes activating a workstation having a chair, operator equipment, and a base. As above, the chair and operator equipment are connected to the base through a pivot point and are movable about the pivot point relative to the base. The chair and operator equipment are pivotable together about the pivot point frontward and backward and into and out of an upright position and a recline position. Once activated, the workstation is automatically pivoted back and forth into and out of the upright and recline positions. The workstation is pivoted through a control having a program configured to pivot the chair and operator equipment together. The chair and operator equipment are automatically pivoted together into and out of the upright and recline positions over a controlled duration, where an orientation of the chair relative to the operator equipment is maintained during pivoting.

Among other benefits, the inventive concepts herein can provide a workstation that can reduce manpower requirements while improving vigilance of workstation operators. By its gradual movement into and out of the upright and recline positions, improved physical comfort can be enjoyed, which correlates with increased vigilance. As a result, an operator's ability to effectively remain at and operate the workstation for longer periods of time increases, thereby reducing the number of persons needed for assignment at the workstation.

DRAWINGS

DETAILED DESCRIPTION

Generally, an improved workstation is described that can improve operator vigilance, while reducing fatigue and physical strain on an operator's body. The workstation generally includes a chair and operator equipment that gradually move together about a pivot point through an automatic and time-controlled program.

The chair and operator equipment move such that an orientation of the chair relative to the operator equipment is maintained during movement. That is, during movement, the entire chair and the operator equipment including its various workstation instruments pivot back and forth into and out of an upright position and a recline position, and while the orientation between the chair and the operator equipment is maintained.

The workstation and methods described herein can be used, for example, where constant and/or extended operator manpower is needed. Such instances may include but are not limited to workstations on naval and military ships, inside military bases, and aircraft such as Airborne Warning and Control Systems (AWACS) aircraft where the weight of the workstation can be made light enough to be supported by such aircraft. These examples are meant to be illustrative only, as other applications may suitably employ the concepts herein where reduction of manpower requirements is desired.

Figure 1:
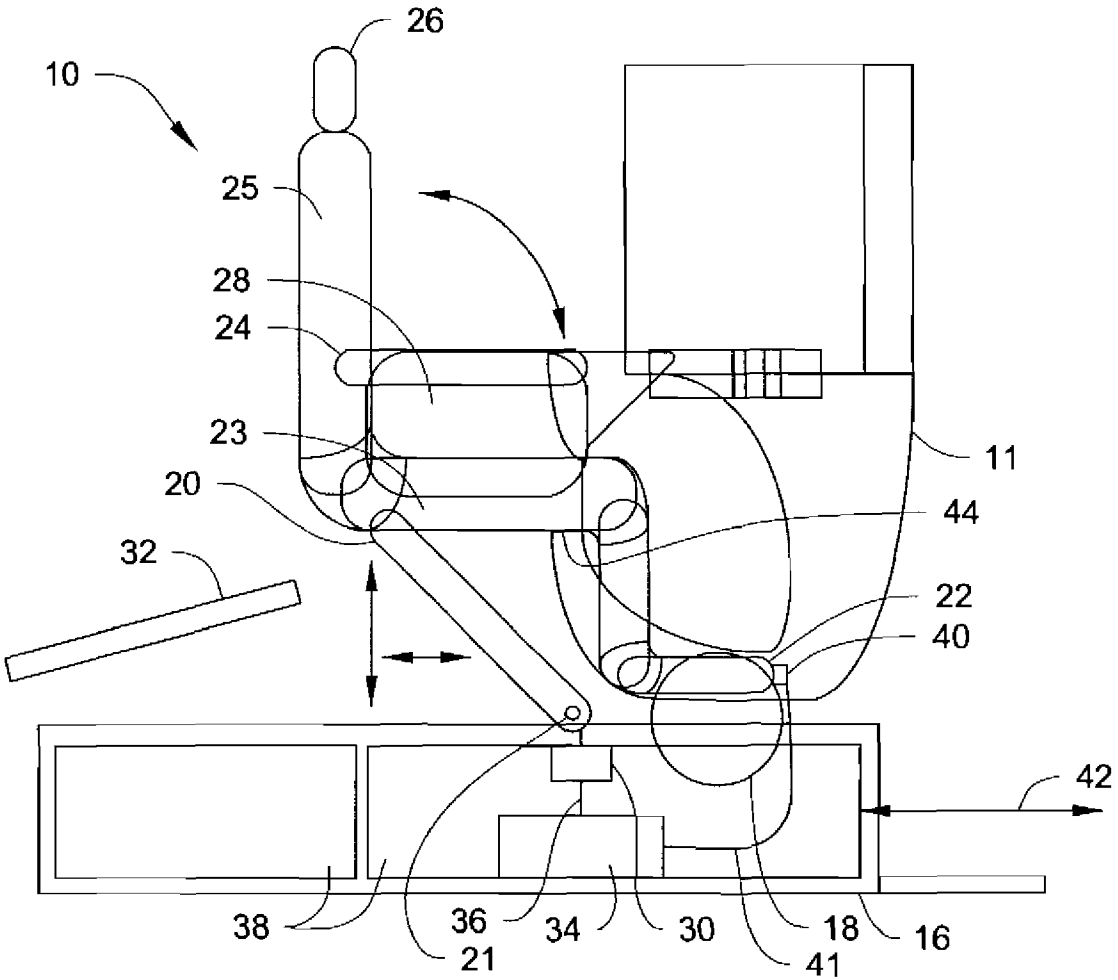
FIG. 1 is a side view of one embodiment of a workstation. The workstation is shown in the upright position.
Figure 2:
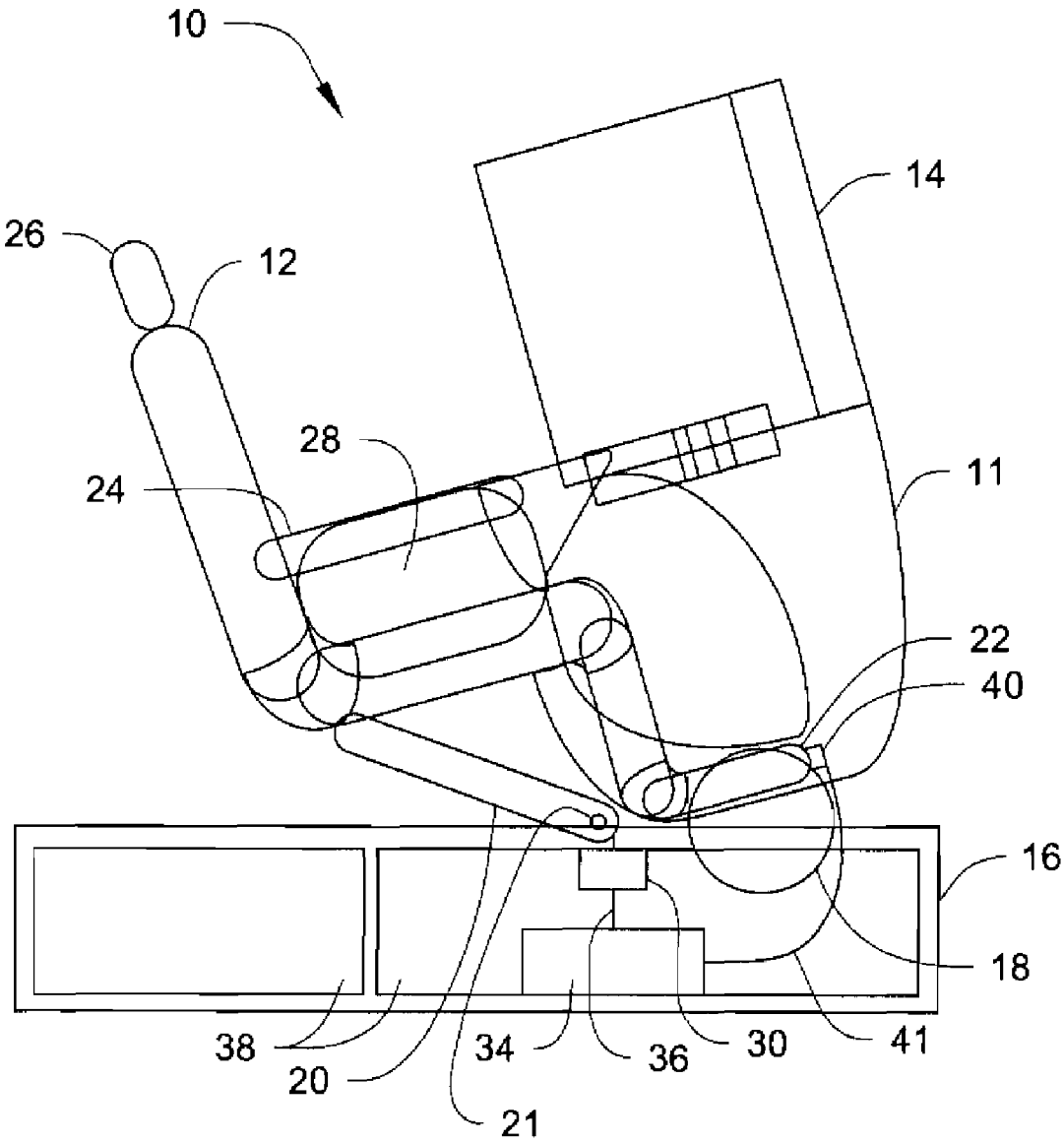
FIG. 2 is a side view of the workstation in FIG. 1 in the recline position.
Figure 3:
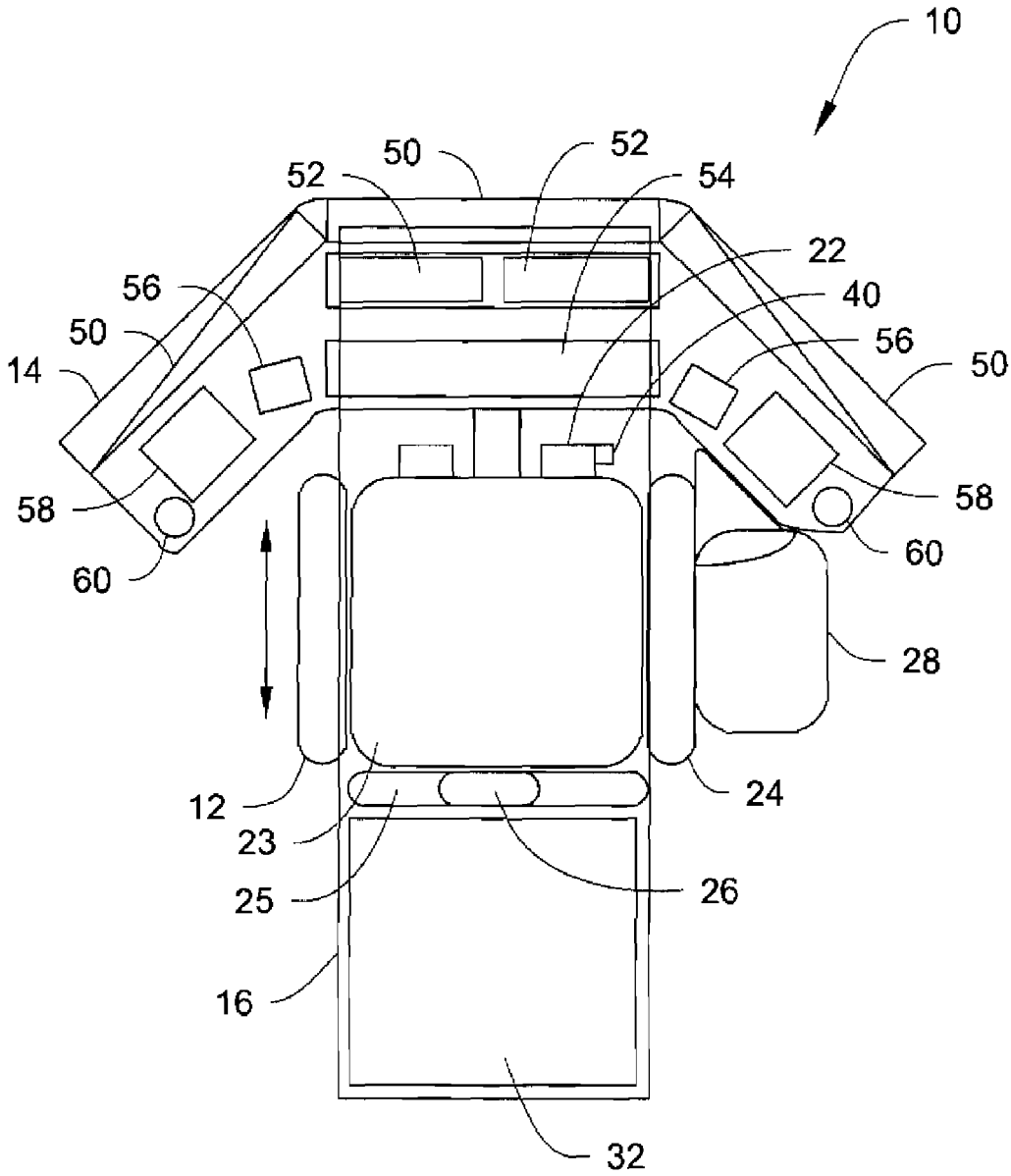
FIG. 3 is a top view of the workstation in FIG. 1.

FIGS. 1-3 illustrate a workstation 10. The workstation 10 generally includes a chair 12 and operator equipment 14 that gradually move together on a single pivot point 18 and with respect to a base 16. A control 34 which is further described below is configured to automatically move the chair 12 and operator equipment 14 under a time-controlled program. When the control 34 is activated, the chair 12 and operator equipment 14 move in a front to back, back to front tilting motion (i.e. rocking motion) about the pivot point 18 and relative to the base 16 (see FIGS. 1 and 3).

The chair 12 and operator equipment 14 are connected to the base 16 through the pivot point 18. The chair 12 and operator equipment 14 are movable about the pivot point 18 relative to the base 16. A linkage 20 moves the chair 12 and operator equipment 14 together when the control 34 is activated. The workstation 10 moves or reclines, including the entire chair 12 and the operator equipment 14 and its various workstation instruments. The workstation 10 can automatically move an operator into and out of a recline position and an upright position.

The pivot point 18 is configured such that the chair 12 and operator equipment 14 are pivotable together both frontward and backward, and into and out of the upright position and recline position. The pivot point 18 allows the orientation of the chair 12 relative to the operator equipment 14 to be maintained during movement, since they move together.

The linkage 20 is connected to the base 16 and at least one of the chair 12 and the operator equipment 14. The linkage 20 is configured to drive the chair 12 and operator equipment 14 into and out of the upright and recline positions. By way of example, the linkage 20 can be an electrically driven screw, ram, or pump, and can be an air or water based pump including for example a hydraulics system or a pneumatics system. It will be appreciated that the specific structure of the linkage 20 is not meant to be limiting, and that any drive mechanism or fluid actuator may be employed that can suitably move the chair 12 and operator equipment 14 into and out of the recline and upright positions.

As one preferred example, an electrically driven screw is used such as an elongated screw that is rotatable when driven by a motor. When the screw is rotated, a pivoting movement can be imparted upon the chair 12 and operator equipment 14 through the linkage 20. It will be appreciated that electrically driven screws are well known in mechanical applications and need not be further described, and that one of skill in the art can suitably employ an electrically driven screw as needed.

As shown in FIGS. 1 and 3, the linkage 20 includes one end pivotally connected to the chair 12 and another end that is pivotally attached to the base 16 through a screw 21. The screw 21 is operatively connected to a motor 30 such as by a wired connection. As shown, the motor 30 can be stored within a storage area 38 of the base 16 and can be connected to the control 34 through wire 36.

In operation, the linkage 20 is movable upward and downward relative to the base 16.

Turning to the control 34, one of the storage areas 38 of the base 16 contains the control 34. When the control 34 is activated, the control 34 is configured to pivot the chair 12 and operator equipment 14 through the linkage 20. The control 34 includes a program configured to control the linkage 20, and configured to automatically pivot the chair 12 and operator equipment 14 together into and out of the upright and recline positions. The program is configured to control the linkage 20 to automatically pivot the chair 12 and operator equipment 14 together over a controlled duration.

In one embodiment, the control 34 is a computer, and the program is a control algorithm that automatically controls the position of the workstation. In one example, the program of the control 34 includes a variable algorithm configured for controlling the linkage to move the chair 12 and the operator equipment 14. The program controls the linkage 20 to pivot the chair 12 and operator equipment 14 together into and out of the upright and recline positions. Such a variable algorithm includes a time, or times, to respectively move the chair 12 and operator equipment 14 to the recline position, maintain the recline position, return the chair 12 and operator equipment 14 to an upright position, and maintain the upright position. In one preferred operation, the reclining motion is meant to be gradual and time limited, and can be programmed with a preset recline speed and reclined duration, the upright movement speed and upright duration also can be programmed with preset speeds and durations.

For example, an operator can start in an upright position for a certain period, and then the workstation can slowly recline over a set period of time. While reclining the operator to a lower position, an operator's weight is distributed away from the operator's midsection. In such a configuration, the workstation 10 can automatically recline an operator to a more comfortable position for a certain amount of time. After reaching the bottom of the recline path, the operator will remain in the fully reclined position for a set period of time. After the set period of time, the operator will be slowly returned to the upright position over a set period of time and remain in the upright position for a set period of time. It will be appreciated that the workstation 10 does not have to start in the upright position, and that the workstation 10 initially can be in the recline position, or any position between the upright position and the recline position.

With some specificity on the time-controlled concept, the control 34 can, for example, provide for a minimum time of about five minutes and a maximum time of about forty minutes to move between the upright and recline positions and to maintain the upright and recline positions. That is, in the forty minutes example, the workstation 10 takes about forty minutes to pivot the chair 12 and operator equipment 14 to the recline position, stays in the recline position for about forty minutes, takes about forty minutes to pivot to the upright position, and stays in the upright position for about forty minutes.

It will be appreciated that the control algorithm can be configured to provide for slower or faster recline and upright movement times, as well as shorter or longer set recline or set upright position durations. It also will be appreciated that such times and durations can be operator dependent and can depend upon the general maintenance of an operator's balance and avoiding vertigo. The particular program or algorithm employed for the control is not meant to be limiting, so long as one of skill in the art can design a program suitable to achieve the automatic and time-controlled movement and setting of the chair 12 and operator equipment 14 together.

In one embodiment, the control 34 of the workstation is configured to activate once the operator is sitting in his/her desired position in the chair 12, for example when other chair settings such as head, foot, and arm rests are set. In other embodiments, the control 34 of the workstation can be actively turned on to start the program of the control 34, such as through a switch or other suitable operator control. The control 34 is configured to continuously operate unless an override function (described below) is activated. In one embodiment, the control 34 is configured to continuously operate when an operator is sitting in the chair 12 in his/her desired position relative to the operator equipment 14. When activated, the control 34 is configured so that the chair 12 and operator equipment 14 are repeatedly pivotable together into and out of the upright position and recline position. That is, the stages of moving to the recline position, staying in the recline position, moving to the upright position, and staying in the upright position are repeated back and forth in a cycle, unless the user manually overrides the control 34.

As described above, the workstation does not have to start in the upright position. The chair 12 and operator equipment 14 are pivotable together starting from any position, including from the upright position to the recline position, from the recline position to the upright position, or from any position between upright position and recline position to one of the upright position to the recline position.

In some embodiments, the workstation 10 includes secondary controls such as a manual override. In one embodiment, the override can be one or more switches shown as component 40 that can deactivate the control 34 and can allow for other manual controls. In one embodiment, the override can be activated to automatically bring the operator to the upright position, and remain in the upright position until the override function is shut off. As one example, a maximum time for the workstation 10 to move from the reclined position to the upright position is about 12 seconds. Another secondary control that can be contained in component 40 is a setting where the operator can adjust a desired recline position for the cycle. In yet another example, the override option may allow the operator to stop the workstation from reclining or moving toward upright or to stop the workstation in its recline or upright position. It also will be appreciated that component 40 can allow for an override to allow for manual tilt/recline, such as in traditional chairs.

With further reference to the chair 12, operator equipment 14, and base 16, these components can be separated and removable from each other for easy and convenient assembly and transport. The entire workstation 10 also is meant to be easily mounted on location but also be readily portable, such as for addressing servicing and/or reallocation needs. It will be appreciated that a variety of mechanical connections, such as bolts and screws may be employed to accomplish these results.

Turning to the chair 12, the chair 12 generally includes a seat 23, back 25, armrests 24, and a footrest 22. The connection of the chair 12 with the pivot point 18 and linkage 20 allows the entire chair 12 to be manually and independently adjustable relative to the operator equipment 14 (see arrow adjacent left arm rest in FIG. 3). That is, the chair 12 is independently adjustable relative to the control 34, while remaining connected to the pivot point 18 and to the linkage 20. Through the pivot point 18, the chair 12 can move in the both the x and y-directions (see e.g. two-way arrows under the linkage 20 in FIG. 1) and through adjustment location 44 the chair independently can move in the x-direction relative to the operator equipment. In such a configuration, an operator can first set or adjust the chair 12 in a desired position with respect to the operator equipment 14. It will be appreciated that the chair 12 can be adjustable to accommodate any person and can be moved relative to the operator equipment 14 at the adjustment location 44 using any manual or mechanical control or other known adjustment mechanism, such as a switch or lever. Much like vehicle chairs, the chair 12 can be manually adjustable to accommodate the foot reaches including the 95 percentile of males and the 95 percentiles of females.

In one operation of the workstation, an operator sits in the chair 12, adjusts the chair 12 relative to the operator equipment 14 in his/her desired position, then the control 34 can be automatically activated for pivoting motion.

Any one or both of the armrests 24 can be moved out of the way to allow for operator ingress and egress from the workstation 10. For example, an armrest 24 pivots proximate the back 25 of the chair 12 in an upward motion toward the back 25 and in a downward motion toward the seat 23 (see curved arrow above arm rest in FIG. 1). Any one or both of the armrests 24 can include a writing surface or another general work surface 28 connected to a side of the arm rest 24. As shown, the writing or general work surface 28 can be moved upward from the side of the armrest 24 and can be moved downward so that it mainly is disposed under the armrest 24 (see and compare FIGS. 1 and 3). In one example, the writing or general work surface 28 is a flip-up/down surface as may be similarly employed in known chairs (e.g. school chairs). The chair 12 can also include a headrest 26 that is adjustable.

The footrest 22 can include the component 40 having the secondary controls (e.g. override switch discussed above). In one embodiment, the component 40 is connected onto the footrest 22 and is operatively connected to the control 34, for example through a wired connection 41. The component 40 connected onto the footrest 22 can allow easy and convenient override of the control 34 if needed.

Turning to the operator equipment 14, FIG. 2 shows a plurality of user interface components and instruments mounted onto a frame 11. The user interface components are removable from the frame 11 and move with the frame 11 when the entire chair 12 and operator equipment 14 are moved together. For example, one or more large display screens 50, touch pads or screens 52, keyboard 54, mouse, trackballs, and joysticks 56 are mounted on the frame 11. The frame 11 can also include various docking stations 58, which can be used for connecting other instruments. Such docking stations 58 can provide remote connections for other instruments, for example a laptop computer. The operator equipment can include any combination of these components and instruments as desired and/or necessary for an operator's job.

In one example, the operator equipment 14 includes a display screen, a keyboard, a mouse, and a touchpad. The components can be mounted and positioned on the frame 11 at various locations as desired and/or necessary, so as to make the operator equipment 14 functional and user-friendly. The frame 11 and any of the components of the operator equipment 14 can be made with quick release hold downs and universal connectors to improve switch out time and interchangeability with various instruments and to accommodate an operator that is either right or left hand dominant. As shown in FIG. 2, the frame 11 can also include a beverage or snack holder 60 for further operator accommodation.

With respect to the base 16, the base 16 stores the electronics for controlling pivoting of the chair 12 and operator equipment 14 together. The electronics that are stored inside the base 16 include the control 34 (e.g. computer) having the algorithm for reclining the chair 12 and operator equipment 14. Any power connections for the control 34 and for the operator equipment 14 that may be necessary also can be stored in the base 16. The electronics make up the control 34 and are stored inside any of the storage areas 38 of the base 16. It will be appreciated that any necessary cabling and electronic connections would be provided for the linkage 20 to pivot the chair 12 and for the operator equipment 14. It will be appreciated that the cabling and electronic connections can be run out of the base 16 to the linkage 20 and/or operator equipment 14 in various implementations as one of skill in the art could accomplish. As one example discussed, wire 36 connects the control 34 to the motor 30 which is connected to the linkage 20 such as through a wire, and a wire 41 connects the control 34 to the component 40 having the override switch.

As shown in FIG. 1 and FIG. 2, the base 16 can also include a removable lid 32 for access to the storage areas 38 inside the base 16. Overall, the base 16 can allow for a lower center of gravity for the workstation 10 as the electronics are stored inside the base 16. In other embodiments, the base 16 may include wheels (not shown), but is otherwise readily loadable onto a dolly or other transport mechanism.

In one embodiment, the total weight of the workstation is approximately 500 pounds or less. Lighter composite materials can be employed for any of the workstation components where possible to help reduce the overall weight. In an example where the workstation is used in a naval ship such as a submarine, the base, chair, and operator equipment can be sized and arranged at approximately 30 inches wide and 48 inches tall so that the components can be loaded onto the ship with enough clearance.

In accordance with the description herein, one method of operation of a workstation includes activating the workstation having the chair, operator equipment, and the base. Activating the workstation can further include first adjusting the chair relative to the operator equipment. The chair and operator equipment are connected to the base through a pivot point and are movable about the pivot point relative to the base. The pivot point is configured such that the chair and operator equipment are pivotable together frontward and backward, and back and forth into and out of the upright position and the recline position. The workstation automatically pivots frontward and backward and back and forth into and out of the upright and recline positions through the control. The control contains the program configured to pivot the chair and operator equipment through a linkage. Automatically pivoting the workstation includes pivoting the chair and operator equipment together back and forth into and out of the upright and recline positions over a controlled duration. As a result, the orientation of the chair relative to the operator equipment is maintained during the pivoting movement.

As one preferred embodiment, automatically pivoting the workstation further includes continuously pivoting the chair and operator equipment together back and forth into and out of the upright and recline positions, while maintaining the orientation of the chair relative to the operator equipment. The disclosure herein can provide benefits, among others, of a workstation that can improve operator vigilance, while reducing fatigue and physical strain on an operator's body.

The invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A workstation comprising:

a chair, operator equipment, and a base, the chair and operator equipment are connected to the base through a pivot point and are movable about the pivot point relative to the base, the chair and operator equipment are pivotable together into and out of an upright position and a recline position, such that an orientation of the chair relative to the operator equipment is maintained during pivoting movement;

a linkage connected to the base and at least one of the chair and the operator equipment, the linkage is configured to drive the chair and operator equipment into and out of the upright and recline positions;

a control disposed within the base, the control is connected to the linkage and the control includes a program configured to control the linkage to automatically pivot the chair and operator equipment together into and out of the upright and recline positions over a controlled duration and in a repeating cycle, wherein the controlled duration of the program includes control of the linkage to maintain the chair and operator equipment in the upright position for a set period of time when moved into the upright position, and to maintain the chair and operator equipment in the recline position for a set period of time when moved into the recline position.

2. The workstation of claim 1, wherein the chair is adjustable relative to the operator equipment so that the orientation of the chair relative to the operator equipment can be set.

3. The workstation of claim 1, wherein the operator equipment comprises a frame having at least one user interface component removably mounted thereon.

4. The workstation of claim 1, wherein the linkage comprises an electrically driven screw or a fluid actuator.

5. The workstation of claim 1, wherein the linkage includes a first end pivotally connected to the chair and a second end pivotally attached to the base.

6. The workstation of claim 1, wherein the chair, operator equipment, and base are separate components that are removable from each other.

7. The workstation of claim 1, wherein the program is configured to control the linkage to continuously pivot the chair and operator equipment into and out of the upright position and recline position.

8. The workstation of claim 1, further comprising a manual override that is operable for deactivating the control.

9. The workstation of claim 8, wherein the chair further comprises a footrest, the manual override is connected to the footrest.

10. The workstation of claim 8, wherein the manual override, when activated, is configured to automatically return the chair and operator equipment to the upright position.

11. The workstation of claim 1, further comprising a storage area inside the base, the storage area contains the control.

12. The workstation of claim 1, further comprising a center of gravity at the base.

13. The workstation of claim 1, further comprising a setting to allow adjustment of the recline position for the cycle.

14. A method of operating a workstation comprising:

activating a control of a workstation having a chair, operator equipment, and a base, the chair and operator equipment are connected to the base through a pivot point, the control includes a program that controls movement of a linkage such that the chair and operator equipment are movable together about the pivot point and relative to the base into and out of an upright position and a recline position; and through the program of the control, automatically pivoting the chair and operator equipment together into and out of the upright and recline positions over a controlled duration and in a repeating cycle, while maintaining an orientation of the chair relative to the operator equipment during pivoting movement; and respectively maintaining the recline and the upright positions, wherein the controlled duration of the program includes control of the linkage to maintain the chair and operator equipment in the upright position for a set period of time when moved into the upright position, and to maintain the chair and operator equipment in the recline position for a set period of time when moved into the recline position.

15. The method of claim 14, further comprising first adjusting the chair relative to the operator equipment before activation.

16. The method of claim 14, wherein automatically pivoting the chair and operator equipment between the upright and recline positions further comprises continuously pivoting the chair and operator equipment together between the upright and recline positions.

* * * * *